United States Patent [19]

Wagner

[11] Patent Number: 4,905,395

[45] Date of Patent: Mar. 6, 1990

[54] INCREASED CAPACITY MAGAZINE FOR FIREARM

[76] Inventor: David M. Wagner, P.O. Box 2276, Weaverville, Calif. 96093

[21] Appl. No.: 306,698

[22] Filed: Feb. 6, 1989

[51] Int. Cl.[4] ..... F41C 25/08

[52] U.S. Cl. ..... 42/17; 42/49.01

[58] Field of Search ..... 42/17, 21, 49.01

[56] References Cited

U.S. PATENT DOCUMENTS

| | | |
|---|---|---|
| 157,623 | 12/1874 | Meigs . |
| 201,855 | 3/1878 | White . |
| 202,613 | 4/1878 | White . |
| 509,091 | 11/1893 | McCullough . |
| 509,548 | 11/1893 | McCullough . |
| 575,265 | 1/1897 | McClean . |
| 580,679 | 4/1897 | Davenport . |
| 586,209 | 7/1897 | Travis . |
| 618,369 | 1/1899 | Wilson . |
| 871,355 | 11/1907 | Morlan . |
| 1,420,471 | 6/1922 | Carter . |
| 2,482,398 | 9/1949 | Blanton et al. . |
| 2,573,003 | 10/1951 | Fraley . |
| 3,757,449 | 9/1973 | Schindler . |
| 3,808,723 | 5/1974 | Erixon . |
| 3,991,501 | 11/1976 | Larsson . |

FOREIGN PATENT DOCUMENTS 284 of 1879 United Kingdom ..... 42/17

*Primary Examiner*—Charles T. Jordan
*Assistant Examiner*—Richard W. Wendtland
*Attorney, Agent, or Firm*—Edward E. Roberts

[57] ABSTRACT

An increased capacity magazine for a firearm, such as a pump shotgun, wherein the shotgun has mounted under the barrel thereof a cylindrical housing, the housing having assembled therein a rotating mechanism including plurality of shell retaining tubes in contiguous lengthwise relation, assembled about, and fixed to, a pivot shaft. The housing includes a center tubular housing and forward and rear housings attached to the ends of the center housing. The rear housing has an opening in alignment with the loading port of the shotgun. The forward housing includes a rotation spring member which, upon emptying of the shells from a shell tube, automatically enables rotation of the tubes within the housing for positioning the next tube in alignment with the loading port. Each tube has a spring member therein for urging against a follower, which in turn urges shells within the tube toward the rear housing. An indexing mechanism is provided for indexing each shell tube, and includes a rotation latch pivotally mounted on the rear housing for coaction with a follower arm of the follower. The shotgun is loaded through the shotgun loading port, and after a shell tube is loaded, the revolving mechanism is rotated to the next tube by a turning knob on the forward housing, which winds the rotation spring. During firing, when a shell tube is empty, the follower automatically releases the rotation latch which allows the revolving mechanism, under rotating spring pressure, to advance to the next shell tube in a direction reverse to that of the loading rotation of the shell tubes.

18 Claims, 1 Drawing Sheet

INCREASED CAPACITY MAGAZINE FOR FIREARM

BACKGROUND OF THE INVENTION

The background of the invention will be discussed in two parts.

1. Field of the Invention

This invention relates to firearms, and more particularly, to a magazine of increased capacity for a firearm, such as a shotgun, which may be attached as part of the manufacture of the weapon or may be used to replace the existing magazine.

2. Description of the Prior Art

Shotguns normally have a tubular magazine which is attached to the weapon just below the barrel. Such magazines usually have a capacity of three to five shotgun shells. For semiautomatic slide action or pump firearms used in law enforcement situations, three to five shots will not suffice.

Various mechanisms have been devised to facilitate rapid loading of firearms, such as revolvers and the like. For example, devices shown as speed loaders are used with revolvers, such as six shot revolvers, with the loader releasably retaining six bullets in the same radial orientation as the handgun for which used. Upon emptying the shells from the cylinder of the revolver, with the loader, six bullets may be simultaneously inserted into the cylinder for rapid loading.

Other shell magazines have been developed for rifles and handguns. Two such early devices for providing the user with a pre-oriented plurality of bullets for rapid loading are shown in U.S. Pat. No. 201,855, entitled "Charging Magazine for a Revolver", which issued to White on Mar. 26, 1878, and U.S. Pat. No. 202,613, entitled "Charging Magazines and Holster for Revolver" issued to the same inventor on Apr. 16, 1878. Both device show a plurality of tubes oriented the same as the orientation of the chambers of the cylinder of the revolver, with each tube holding a plurality of bullets, with all tubes simultaneously dispensing one bullet at a time.

Another such magazine is shown and described in U.S. Pat. No. 586,209, entitled "Temporary Cartridge Holder", issued to Travis on July 13, 1897.

A tubular cartridge magazine for holding a plurality of cartridges for dispensing one at a time is shown in U.S. Pat. No. 871,355, entitled "Rifle Loader", which patent issued to Morlan on Nov. 19, 1907. Other such devices utilizing, at least in part, tubes for retaining cartridges therein, are shown in U.S. Pat. Nos. 2,573,003, entitled "Cartridge Dispenser", which issued to Fraley on Oct. 31, 1951, and 3,757,449, entitled "Device for Loading Shells", which issued to Schindler on Sept. 11, 1973.

The above concept has even been applied to power tools, such as the device shown in U.S. Pat. No. 3,808,723, entitled "Cartridge Magazine for Power Tools", which issued to Erixon on May 7, 1974, the patent disclosing a device in which a magazine having one or more tubes is mounted adjacent the cartridge chamber. After loading one cartridge into the chamber, the tube is pivoted or moved out of the way to enable firing of the power tool mechanism.

Still another loading magazine is shown and described in U.S. Pat. No. 3,991,501, entitled "Loading Magazine", which issued to Larsson on Nov. 16, 1976, the device being intended to hold a plurality of cartridges or shells in a container for subsequent loading into a weapon.

All of the above devices are simply containers for cartridges or shells separate from the firing and ejecting mechanism of the gun, be it revolver, rifle or power tool, and are simply used to dispense one, or a predetermined pattern of a predetermined number of cartridges into the gun.

In accordance with an aspect of the present invention, it is an object of the invention to provide a new and improved magazine for increasing the capacity of a shotgun.

SUMMARY OF THE INVENTION

The foregoing and other objects of the invention are accomplished by providing a shotgun having mounted under the barrel thereof a cylindrical housing, fixedly attachable beneath the barrel of a shotgun, the housing having assembled therein a plurality of shell retaining tubes (preferably three) in contiguous lengthwise relation, assembled about, and fixed to, a pivot shaft. The housing includes a center tubular housing and forward and rear housings attached to the ends of the center housing. The rear housing has an opening in alignment with the loading port of the shotgun. The forward housing includes a rotation spring member which, upon emptying of the shells from a shell tube, automatically enables rotation of the tubes within the housing for positioning the next tube in alignment with the loading port. An indexing mechanism is provided for indexing each shell tube, in turn, into alignment with the loading port of the weapon. Each tube has a spring member therein for urging against a follower, which in turn urges shells within the tube toward the rear housing. The indexing mechanism includes a rotation latch pivotally mounted on the rear housing for coaction with a follower arm of the follower. By way of example, each tube may have a capacity of five shots, thereby providing a magazine of fifteen shells, in contrast to the normal three to five shell capacity.

The shotgun may be loaded through the normal shell loading opening, and after a shell tube is loaded, the revolving mechanism is rotated to the next tube by a turning knob on the forward housing, which winds the rotation spring. During firing, when a shell tube is empty, the follower automatically releases the rotation latch which allows the revolving mechanism, under rotating spring pressure, to advance to the next shell tube in a direction reverse to that of the loading rotation of the shell tubes.

Other objects, features and advantages of the invention will become readily apparent from a reading of the specification, when taken in conjunction with the drawings, in which like reference numerals refer to like elements in the several views.

DESCRIPTION OF THE PREFERRED EMBODIMENT

Figure 1:
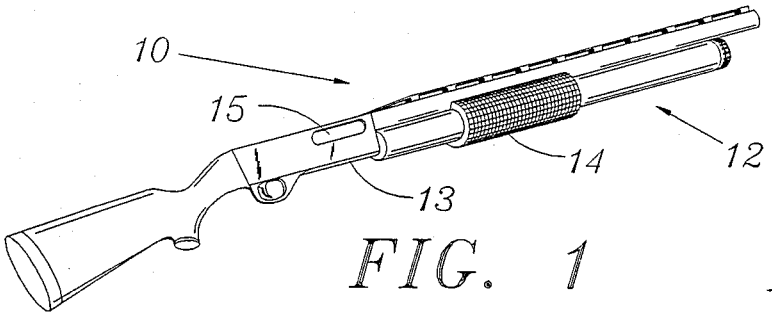
FIG. 1 is a perspective view of a shotgun having the increased capacity magazine according to the invention.

Referring now to the drawings, and particularly to FIG. 1, there is shown an increased capacity magazine 12 adapted to a shotgun 10 of the pump type, in accordance with the invention. By way of comparison, a normal twelve gauge shotgun 10 has a barrel, measured at the muzzle, of about seven-eighths of an inch in diameter. The chamber has an enlarged opening for receiving the brass rim of the shotgun shell, this opening being about fifteen sixteenths of an inch. The pump gun 10 includes a fore end 14, which is manually pulled back to eject the spent shell and moved forward to chamber the next shell. In a pump gun, the fore end 14 is interconnected to the shell chambering and ejection mechanism 15 by a pair of linkage arms which fit in proximate relation to the barrel intermediate the barrel and the shell feed tube. Shells are loaded through a port 13 beneath the ejection opening.

In accordance with the present invention, to modify a conventional pump gun, the magazine 12 is attached to the barrel with a fore end 14 fitted to conform to the diameter of the increased capacity magazine 12. By way of example, a shell feed tube of a conventional pump gun is about one inch in diameter with about a quarter to three eighths of an inch spacing between the barrel and the feed tube.

With the present magazine, as will be described, there are three shell tubes arranged about a center shaft within a cylindrical housing, with each tube a little less than an inch in diameter with the cylindrical housing having a diameter of about two inches. Thus the increases capacity does not significantly alter the dimensions of the shotgun 10 while providing an increased capacity of three or more times a conventional shotgun of roughly the same gauge and dimensions.

Figure 2:
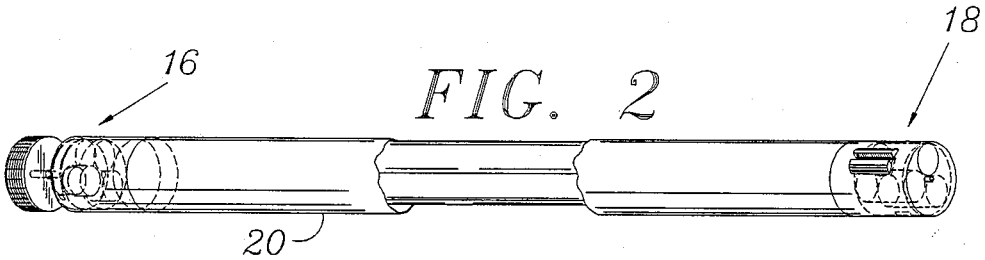
FIG. 2 is a perspective view of the magazine of FIG. 1 detached from the shotgun of FIG. 1, with components thereof shown in broken lines.
Figure 6:
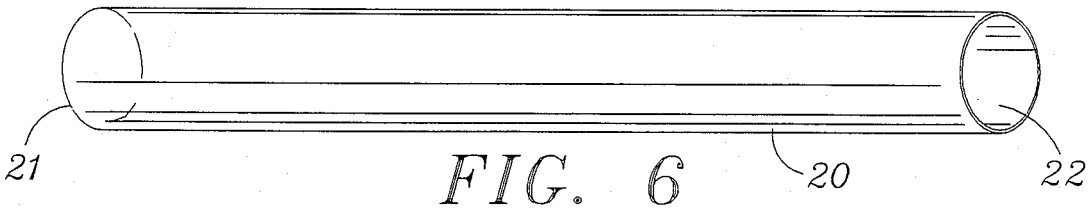
FIG. 6 is a perspective view of the center housing of the magazine of FIG. 2.

As shown in FIG. 2, the magazine 12 includes a forward housing generally designated 16, a rear housing generally designated 18, and a center housing 20, each of which is the same diameter and adapted for connection end to end to form the housing for the magazine 12. The center housing 20 (See also FIG. 6) is a tubular sleeve member having open ends 21, 22. The rear housing 18 is of a generally cup-shaped configuration with a bottom 23 having a port 24 which aligns with the loading port of the shotgun 10. A mounting shaft, or projection, 25 extends from the bottom 23 at the center thereof.

Figure 3:
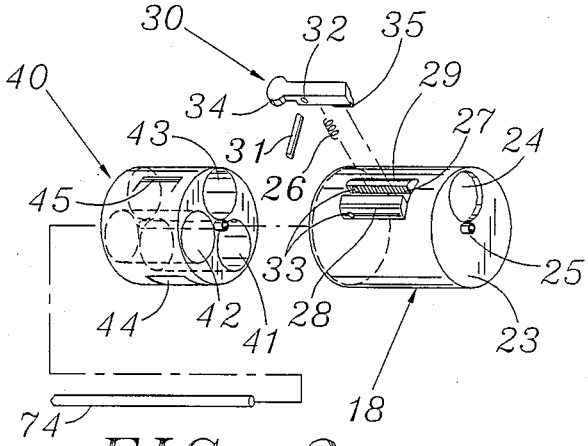
FIG. 3 is an exploded perspective view of the rear housing and rear carrier of the magazine of FIG. 2 in exploded relation to a portion of the center shaft of the magazine of FIG. 2.

On the other drum surface of the rear housing 18, there is a slotted opening 27 straddled by first and second outwardly protruding bar members 28 and 29. The members 28 and 29 are configured and dimensioned for pivotally receiving a rotation latch member 30. The latch member 30 is provided with a lateral aperture 32, which receives a pin 31 which engages aligned apertures 33 in the bar members 28, 29. As shown in FIG. 3, the pivot aperture of latch member 30 is spaced from one end which has a disc-shaped tab projection 34 lying in a plane parallel to the direction of the pivot aperture 32.

The balance of the member 30 is generally bar-shaped with a protruding detent portion 35. As configured, with the member 30 assembled within the slot 27, a small coil spring 26 is interposed between the tab projection 34 and the drum surface of rear housing 18 to produce a spring bias for urging the detent portion 35 inwardly relative to the slot 27. As will be described, in the assembled position, the edge of the detent portion 35 protrudes through the slot 27 to ride on or at the surface of the rear shell tube carrier 40 under spring pressure.

Assembled within the interior of the rear housing 18 is a rear shell tube carrier 40, which is cylindrically configured for being rotatably received within the rear housing 18. The carrier 40 has secured therein first, second and third tube segments 41–43, which are tangential to one another adjacent the center of the carrier 40, with each tube segment 41–43 also being tangential to the interior of the carrier 40. The tube segments 41–43 are open at both ends and have an interior diameter sufficient for receiving therein one end of the shell tubes 50 (See FIG. 5). The exterior of the carrier 40 is provided with three equiangularly positioned generally identical indexing tabs which define beveled indexing slots 44, 45 (only two of which are shown). The indexing tabs are formed by cutting and inwardly deforming portions of the exterior of the carrier 40 to form the slots 44, 45.

Figure 4:
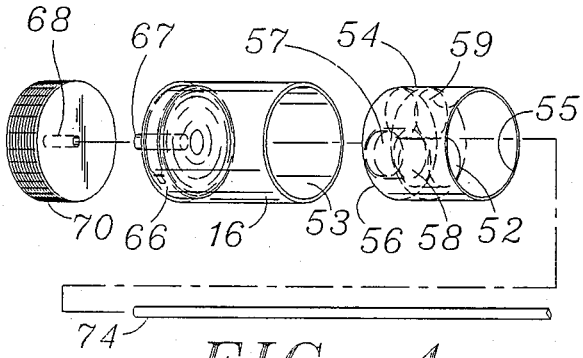
FIG. 4 is an exploded perspective view of the forward housing, forward carrier, and turning knob of the magazine of FIG. 2 in exploded relation to a portion of the center shaft of the magazone of FIG. 2.

Referring now to FIG. 4, the forward housing 16 is generally cup-shaped with the open end 53 being configured for rotatably receiving therein a front shell tube carrier 54. The carrier 54 has an open end 55 and a closed bottom 56 with first second and third tube segments 57–59 secured therein. The tube segments 57–59 are shorter in length and are configured with an internal diameter sufficient for receiving the other ends of the shell tubes 50 therein. The angular positioning of the tube segments 57–59 is identical to the positioning of the tube segments 41–43 of rear carrier 40.

The housing 16, at the end opposite the opening 53 includes a spring mechanism 66, with a central axially extending tubular projection 67 which acts as the front support and is configured for passage therethrough of the assembly pivot shaft 74. A manual drum-shaped turning knob 70 is provided and is configured with a tubular axial projection 68 through which shaft 74 passes, the knob 70 then being keyed to the shaft 74 (See FIG. 4) for concurrent rotation with or against the force of the spiral spring member 66. The pivot shaft 74 is, in turn, secured relative to the shell tube carriers 40 and 54 to provide concurrent rotation and indexing as appropriate. The spring member 66 has the inner end secured to the forward shell tube carrier 54 and the outer end secured to the forward housing 16.

Figure 5:
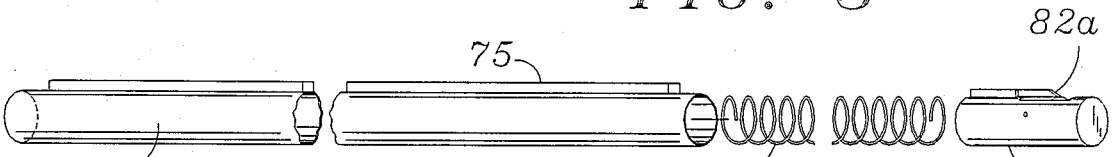
FIG. 5 is an exploded perspective view of one of the three shell tube assemblies for use in the magazine of FIG. 2.

FIG. 5 shows one shell tube 50, with a spine or guide slot 75 along a major part of the length thereof. The guide slot 75 is formed as a radial projection of the shell tube 50 to form a somewhat key-shaped opening. As will be described, the slot within the tube acts as a guide for the follower member 82, which, in turn, actuates the indexing mechanism.

Opposite ends of the metal shaft 74 extend beyond the ends of shell tube 50 a distance sufficient for engagement with the front and rear housings 16 and 18. The forward end of shaft 74 is immovably mounted within receiving hole 68 and knob 70, and is configured for being received through tubular projection 67, which acts as a pivot bearing, while the rear end is configured for being received within mounting shaft, or projection, 25 of the rear housing 18. Second and third shell tubes 50 (See FIGS. 2 and 7), are secured within the housing 120 degrees apart from one another with the shell tubes 50 oriented for being received within the tube segments 41–43 of the rear carrier 40 and forward carrier segments 57–59.

Each shell tub 50 is configured for receiving therein an elongate follower spring 80 and a follower 82. The spring 80 is of a length sufficient for urging the maximum number of shells therein (in this example, five shells) toward the opposite or rear end of the tube 50. The follower 82 has a main body portion which is generally hollow and rod-shaped with an outer diameter conforming to the inner diameter of a shell tube 50 and acts as a pusher member under force of the spring 80 for urging shells within the tube 50 toward the rear end or bottom 23 of rear housing 18.

Two of the three followers 82 have a portion thereof configured with a follower bar **82*a* which is received within the guide slot 75 and, as will be described, coacts with the projection 35 of the rotation latch 30 during operation. The third follower (not shown) does not include the follower bar 82*a*, since the shell tube assembly does not rotate beyond the third position. With a particular shell tube 50 in alignment with the port 24, the spring 80 and follower 82 urge the shells within the tube 50, in turn, through the port 24 for chambering within the shotgun 10. As assembled, the follower spring 80 has one end thereof urging against the follower 82 and the other end thereof fitted within and urging against the bottom of one of the tube segments 57–59 of the front shell tube carrier 54**.

Figure 7:
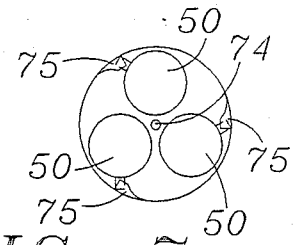
FIG. 7 is a cross-sectional diagrammatic view of the shell tubes fitted within the housing to show detail of the indexing mechanism of the magazine of FIG. 2.

For assembly, the front shell tube carrier 54 is keyed to the center pivot shaft 74. The three shell tubes 50 are then attached to the carrier 54 by insertion of the end portions thereof into the tube segments 57–59. As shown in FIG. 7, the guide slots 75 of the tubes 50 are oriented outwardly for alignment with the beveled indexing slots 44, 45 of the rear carrier 40. As shown in FIG. 3, the guide slot 75 terminates short of the end of tube 50, with this spacing corresponding to the location of the indexing slots 44, 45. The three follower springs 80 are then inserted into the tubes 50, after which the followers 82 are inserted into the tubes 50 against the force of the springs 80 with the follower bar portions **82*a* received within guide slots 75. The adjacent end of each spring 80 is received within the hollow recess of the follower 80**.

The rear carrier 40 is then attached to the other ends of the shell tubes 50 by positioning the ends within the carrier segments 41–43, whereupon springs 80 and followers 82 are enclosed within the shell tubes 50. The rear carrier 40 is then keyed to the center pivot shaft 74. The center shaft 74 is of a length sufficient to protrude through the rear carrier 40 to engage the mounting shaft or projection 25 of rear housing 18, which acts as a pivot bearing. Likewise the center shaft 74 is of a length sufficient to pass through forward housing at mounting shaft or projection 67 for engagement with and keying to the turning knob 70 at the tubular axial projection 68.

The rotation spiral spring 66 is then secured to the forward carrier 54 at the inner end and to the forward housing 16 at the outer end. The forward carrier 54 is then inserted into the the forward housing 16 and the forward end of the center shaft 74, which protrudes through tubular projection 67, is keyed to the turning knob 70 at the knob projection 68.

The center housing 20 is then placed over the shell tubes 50 and attached to the forward housing 16. The rear housing 18 is placed over the rear carrier 40 and is attached to the center housing 20 with the protruding end of shaft 74 inserted into the pivot bearings 25. The rotation latch 30 is then attached to side bars 28 and 29 by means of spring member 26 and pin 31 for enabling positioning of the detent portion 35 of rotation latch 30 into slot 27 under spring pressure. This detent portion 35 protruding through slot 27 will be in alignment with the path of travel of the follower bar **82*a* of follower 82. Correspondingly, this detent portion 82*a* will be in the path of travel of indexing slots 44, 45**.

The magazone 12 is then mounted to the shotgun 10 with the rear housing 18 pinned to the shotgun 10 with the port 24 in alignment with the loading port 13 of the weapon as shown in FIG. 1. As assembled, the front and rear housings 16 and 18, along with the center housing 20, remain stationary. The carriers 40 and 54, along with the shell tubes 50 assembled thereto, rotate as a unit within the housing thus formed.

In brief, loading the shell tube 50 depresses the follower 82, releases the follower bar **82*a*, and compresses the follower spring 80. Clockwise rotation of the turning knob 70 raises the rotation latch 30 against the force of its spring 26 until detent portion 35 is detented with one of the beveled indexing slots 44, 45 on the surface of the rear shell tube carrier 40. At 120 degrees, the rotation latch 30 engages the next indexing slot 44, 45 on the rear shell tube carrier 40. This rotation winds or stores energy in the rotating spring 66. This action is repeated for the second and third shell tubes 50**.

In operation, for loading, shells are loaded through the port 13 of the shotgun through the port 24 of the rear housing into a shell tube 50. After the maximum number of shells are loaded, such as five, the shell tube assembly is rotated by means of the turning knob 70 which advances the next shell tube 50 into position for loading. After the second shell tube 50 is loaded, the turning knob is again rotated in the same direction to index the next shell tube 50 for loading. This turning of the knob 70 stores energy in the spring mechanism 66, which energy will be used in rotating the shell tube assembly in the opposite direction after each shell tube 50 is emptied of shells.

During use of the weapon 10, such as by shooting, firing of all shots from the first shell tube 50 causes the follower bar **82*a* of follower 82 to contact the detent portion 35 of rotation latch 30, thereby releasing the rotation latch 30 against the force of spring 26 from the indexing slot 44, 45 in the rear shell tube carrier 40. Under spring pressure of spring mechanism 66, the shell tube assembly rotates counter clockwise. The detent 35 then rides against the surface of the rear carrier 40, until, at 120 degrees, the detent 35 of rotation latch 30 engages the next beveled slot 44, 46 to index the mechanism to the next shell tube 50. This action is repeated for the second and third shell tubes 50**.

For manual unloading, the operator unloads the first shell tube 50 conventionally as he would a normal shotgun, and the follower 82 operates the same as in the firing sequence described above, that is, automatically advancing to the next shell tube containing shells. It is again emphasized that the third shell tube follower 82 does not carry the follower bar, since the shell tube assembly does not rotate beyond the third position.

The indexing in the opposite direction during firing or unloading is automatic and accomplished via the interaction of follower bar 82*a* with the detent portion 35 of the spring biased rotation latch 30 alternately causing engagement of the detent portion 35 with the indexing slots 44, 45, As each shell within a shell tube 50 is chambered in the shotgun 10, the follower advances, that is, it moves axially rearwardly. When the last shell of the tube 50 is discharged from the tube 50, the follower 82 is adjacent an indexing slot 44, 45.

In this position, the follower arm 82*a* of the follower 82 engages the detent portion 35 of the rotation latch 30 to thereby force the rotation latch 30 outwards. This movement, in turn, disengages the projection 35 from its index slot 44 or 45, thereby enabling the carrier 40 within housing 18 to rotate under force of the spiral spring 66 to the next indexing slot 44, 45, which is then engaged by the detent 35 which then aligns the next shell tube 50 with the port 24. The action continues to the next shell tube 50 after the supply of shells is exhausted.

In this manner, the shotgun 10 is provided with an increased magazine capacity of three times normal while maintaining the original action of the weapon. It is to be understood that the magazine of the instant invention can be equally utilized in a rifle having a tubular magazine.

While there has been shown and described a preferred embodiment, it is to be understood that various other adaptations and modifications may be made within the spirit and scope of the invention.

What is claimed is:

1. In a firearm having a loading port for receiving shells from a magazine comprising:

housing means attached to the firearm in fixed relation to the barrel thereof;

port means in said housing means in alignment with the loading port;

carrier means rotatably mounted within said housing means;

a plurality of shell tube means fixedly attached to said carrier means, each of said shell tube means being configured and dimensioned for receiving and dispensing a plurality of shells therefrom, each of said shell tube means being arranged for sequential alignment with said port means;

spring mans within each of said shell tube means for urging shells therein toward said port means;

other spring means in cooperative relation between said carrier means and said housing means;

means for rotating said carrier means against the force of said other spring means during loading of shells into said shell tube means, said means for rotating enabling storing of energy in said other spring means while loading said shell tubes, and indexing means responsive to discharge of all shells from one of said shell tube means for rotating said carrier means under force of said other spring means for aligning another shell tube means with said port means.

2. The combination according to claim 1 wherein said housing means is a cylindrically configured housing.

3. The combination according to claim 2 wherein said plurality of shell tube means includes three generally identical cylindrical tube members arranged in abutting relation about a pivot axis for rotation within said housing.

4. The combination according to claim 2 wherein said carrier means includes first and second carriers configured for rotation within said housing.

5. The combination according to claim 4 wherein said each of said carrier means is at an opposite end of said housing and said plurality of shell tube means includes three generally identical cylindrical tube members arranged in abutting relation and secured at opposite ends to said carriers.

6. In a firearm having a loading port for receiving shells from a magazine comprising:

a cylindrically configured housing attached to the firearm in fixed relation to the barrel thereof;

port means in said housing means in alignment with the loading port;

carrier means rotatably mounted within said housing, said carrier means including first and second carriers configured for rotation within said housing, each of said carriers being at an opposite end of said housing;

a plurality of shell tube means fixedly attached to said carrier means, each of said shell tube means being configured and dimensioned for receiving and dispensing a plurality of shells therefrom, each of said shell tube means being arranged for sequential alignment with said port means, said plurality of shell tube means including three generally identical cylindrical tube members arranged in abutting relation and secured at opposite ends to said carriers;

spring means within each of said cylindrical tube members for urging shells therein toward said port means;

a spiral spring in cooperative relation between one of said carriers and said housing;

a manual turning knob for rotating said carrier means against the force of said spiral spring during loading of shells into said shell tube means, said knob enabling storing of energy in said spiral spring while loading said shell tubes; and indexing means responsive to discharge of all shells from one of said cylindrical tube members for rotating said carrier means under force of said spiral spring for aligning another tube member with said port means.

7. The combination according to claim 6 wherein said indexing means includes means on the other of said carriers and means on said housing actuable in response to passage of the last shell from a shell tube through the loading port of the firearm.

8. In a firearm having a loading port adjacent the chamber of the firearm for receiving shells from a magazine, an improved magazine comprising:

housing means attached to the firearm weapon in fixed relation to the barrel thereof;

port means in said housing means in alignment with the loading port;

a shell tube assembly means rotatably mounted within said housing means, and including a plurality of shell tubes, each of said shell tubes being configured and dimensioned for receiving and dispensing a plurality of shells therefrom, each of said shell tubes being arranged for alignment with said port means on rotation of said assembly;

spring means within each of said shell tubes for urging shells therein toward said port means;

other spring means in cooperative relation between said housing means and said shell tube assembly;

means for rotating said shell tube assembly against the force of said other spring means during loading of shells into said shell tube means, said means for rotating enabling storing of energy in said other spring means while loading said shell tubes; and indexing means responsive to discharge of all shells from one of said shell tube means for rotating said shell tube assembly under force of said other spring means for aligning another shell tube with said port means.

9. The magazine according to claim 8 wherein said indexing means includes rotation latch means in coacting engagement with said housing and said shell tube assembly, and follower means within each of said shell tubes intermediate said spring means and shells therein, and wherein said rotation latch means is actuated by said follower means.

10. The magazine according to claim 9 wherein said shell tube assembly includes first and second carriers supporting at least three shell tubes with said carriers being rotatably mounted within said housing.

11. The magazine according to claim 10 wherein said housing is cylindrically configured and each of said shell tubes is cylindrically configured.

12. In a shotgun having a barrel, the combination comprising:

a loading port adjacent the chamber of the shotgun for receiving shells;

magazine housing means attached to the shotgun is fixed relation below the barrel thereof;

port means in said housing means in alignment with said loading port;

a shell tube assembly means rotatably mounted within said housing means, and including a plurality of shell tubes, each of said shell tubes being configured and dimensioned for receiving and dispensing a plurality of shells therefrom, each of said shell tubes being arranged for alignment with said port means on rotation of said assembly;

spring biased means within each of said shell tubes for urging shells therein toward said port means;

spring means in cooperative relation between said housing means and said shell tube assembly;

means for rotating said shell tube assembly against the force of said spring means during loading of shells into said shell tube means, said means for rotating enabling storing of energy in said spring means while loading said shell tubes; and indexing means operable in response to said spring biased means upon discharge of all shells from one of said shell tube means for rotating said shell tube assembly under force of said spring means for aligning another shell tube said said port means.

13. The shotgun according to claim 12 wherein said indexing means includes spring biased latch means in cooperative relation between said housing means and said shell tube assembly for maintaining the relative position therebetween.

14. The shotgun according to claim 13 wherein said spring biased means within said shell tube includes a spring member and a follower, and said latch means are released in response to coaction with said follower.

15. The shotgun according to claim 12 wherein said shell tube assembly includes first and second carriers supporting at least three shell tubes with said carriers being rotatably mounted within said housing.

16. The magazine according to claim 12 wherein said housing is cylindrically configured and each of said shell tubes is cylindrically configured.

17. In a firearm having a loading port adjacent the chamber of the firearm for receiving shells from a magazine, an improved magazine comprising:

a cylindrically configured housing attached to the firearm weapon in fixed relation to the barrel thereof;

port means in said housing in alignment with the loading port;

a shell tube assembly means rotatably mounted within said housing, and including a plurality of cylindrically configured shell tubes, each of said shell tubes being configured and dimensioned for receiving and dispensing a plurality of shells therefrom, each of said shell tubes being arranged for alignment with said port means on rotation of said assembly, said shell tube assembly including first and second carriers supporting at least three shell tubes with said carriers being rotatably mounted within said housing;

spring means within each of said shell tubes for urging shells therein toward said port means;

a spiral spring in cooperative relation between one of said carriers and said housing;

a manual turning knob for rotating said shell tube assembly against the force of said other spring means during loading of shells into said shell tube means, turning of said knob enabling storing of energy in said spiral spring while loading said shell tubes; and indexing means responsive to discharge of all shells from one of said shell tube means for rotating said shell tube assembly under force of said other spring means for aligning another shell tube with said port means, said indexing means including rotation latch means in coacting engagement with said housing and said shell tube assembly, and follower means within each of said shell tubes intermediate said spring means and shells therein, and wherein said rotation latch means is actuated by said follow means.

18. In a shotgun having a barrel, the combination comprising:

a loading port adjacent the chamber of the shotgun for receiving shells;

magazine housing means attached to the shotgun in fixed relation below the barrel thereof;

port means in said housing means in alignment with said loading port;

a shell tube assembly means rotatably mounted within said housing means, and including a plurality of shell tubes, each of said shell tubes being configured and dimensioned for receiving and dispensing a plurality of shells therefrom, each of said shell tubes being arranged for alignment with said port means on rotation of said assembly, said shell tube assembly including first and second carriers supporting at least three shell tubes with said carriers being rotatably mounted within said housing means;

spring biased means within each of said shell tubes for urging shells therein toward said port means;

a spiral spring in cooperative relation between one of said carriers and said housing means;

means for rotating said shell tube assembly against the force of said spiral spring during loading of shells into said shell tube means, said means for rotating including a manual turning knob for enabling storing of energy in said spiral spring while loading said shell tubes; and indexing means operable in response to said spring biased means upon discharge of all shells from one of said shell tube means for rotating said shell tube assembly under force of said spiral spring for aligning another shell tube with said port means.

* * * * *